United States Patent [19]

Marquis et al.

[11] 4,331,305

[45] May 25, 1982

[54] RIGID AND COMPRESSIBLE DYE TUBES

[75] Inventors: Robert P. Marquis, Bromont; Peter Weileder, West-Brome, both of Canada

[73] Assignee: Plastech Inc., Cowansville, Canada

[21] Appl. No.: 190,601

[22] Filed: Sep. 25, 1980

[51] Int. Cl.[3] ..... B65H 75/20

[52] U.S. Cl. ..... 242/118.11

[58] Field of Search ..... 242/118.11, 118.1, 118.2, 242/118; 68/189, 198

[56] References Cited

U.S. PATENT DOCUMENTS

| | | | |
|---|---|---|---|
| 2,888,258 | 5/1959 | Hoffstrom | 242/118.11 X |
| 3,465,894 | 9/1969 | Tigges | 242/118.11 |
| 3,561,697 | 2/1971 | Egyptien | 242/118.11 |
| 3,753,534 | 8/1973 | Ono | 242/118.11 |
| 3,827,652 | 8/1974 | Burchette | 242/118.11 |
| 4,181,274 | 1/1980 | Burchette | 242/118.11 |

*Primary Examiner*—Edward J. McCarthy
*Attorney, Agent, or Firm*—Alan Swabey; Robert Mitchell; Guy Houle

[57] ABSTRACT

A sleeve for use in the treatment of textile threads and yarns including dying having a shell wherein the shell comprises peripherally extending spaced apart rings which are elastically yielding in the axial direction of the shell and spaced-apart webs which are elastically yielding in the axial direction of the shell, connecting the rings, the axially consecutive webs being laterally offset relative to each other whereby when the rings and webs are yielding, the rings become serpentine and the webs become bowed, at least selected ones of the webs being adapted to bow in a selected common direction generally circumferential with respect to the sleeve to ensure substantially uniform displacement of the sleeve members, thus to provide a sleeve having minimum restriction for passage of dye and which sleeve is substantially rigid in yielded or non-yielded state. In a further embodiment a similar sleeve is provided wherein the webs are grouped in pairs to provide axially consecutive pairs of webs laterally offset relative to each other whereby when the rings and the webs are yielding in response to axial compression of the sleeve, the rings become serpentine and the webs become bowed. In still a further embodiment, a sleeve similar to the first mentioned is provided wherein the axially consecutive webs being laterally offset relative to each other are all adapted to yield uniformly during compression of the sleeve, as for example during a dying operation.

15 Claims, 8 Drawing Figures

RIGID AND COMPRESSIBLE DYE TUBES

BACKGROUND OF THE INVENTION (a) Field of the Invention

The present invention relates to dye tubes, also known as dye springs and the like and more particularly to improvements therein.

(b) Description of the Prior Art

Rigid and compressible dye tubes comprising sleeves of thermoplastic and other material or ones which maybe similarly constructed, for treatment of textile threads and yarns, are known as for example disclosed in Hahm's U.S. Pat. No. 3,561,696 dated Feb. 9, 1971 and Burchette's U.S. Pat. No. 4,181,274 dated Jan. 1, 1980. Various other examples are known including Burchette's Canadian Pat. No. 1,006,862 dated Mar. 15, 1977; Hahm's U.S. Pat. No. 3,563,491 dated Feb. 16, 1971; Nobutaka Ono et al U.S. Pat. No. 3,753,534 dated Aug. 21, 1973; Tigges et al U.S. Pat. No. 3,465,984 dated Sept. 9, 1969; Henning's U.S. Pat. No. 3,647,156 dated Mar. 7, 1972; Draper's Canadian Pat. No. 954,325 dated Sept. 10, 1974; Egyptien's U.S. Pat. No. 3,561,697 dated Feb. 9, 1971; Sottosanti's U.S. Pat. No. 3,718,287 dated Feb. 27, 1973; Draper's U.S. Pat. No. 3,756,532 dated Sept. 4, 1973 and Frank et al U.S. Pat. No. 3,929,301 dated Dec. 30, 1975.

A major disadvantage in respect of the prior art tubes is that they do not possess a combination of desirable properties including being rigid, having a "close knit" sleeve surface, in a non-compressed state, i.e., for use in winding, highly compressible and when compressed, having a "close knit" sleeve surface yet well and uniformly apertured, which provides a minimum of restriction for the passage of dye, during dying operation. Also, wherein all the web members, discussed hereinafter, remain in a noncollapsed state and give spring resilience to the tube, such being a disadvantage in respect of for example Burchette's tube disclosed in U.S. Pat. No. 4,181,274 mentioned above. Furthermore, to provide a tube light in weight which maybe constructed using relatively simple molds and relatively small amount of material to thus provide a tube of low cost.

SUMMARY OF INVENTION

It is therefore an important object of the present invention to provide an improved dye tube and the like which overcome the aforementioned disadvantages and furthermore retains other advantages of the prior art tubes.

The aforementioned important object and others is achieved in providing a design of dye tube wherein all the members comprising the sleeve portion being that portion intermediate the end rings thereof, are elastically and plastically yielding in the axial direction of the sleeve. In particular, wherein all the members become arcuate during yielding and provide a sleeve wall construction well apertured to ensure minimum obstruction for the passage of dye. The aforementioned arcuate shape taken up by all the members and especially the bowing of the web members discussed hereinafter, provides a tube having a combination of special and very desirable characteristics, including resilience. A further aspect of the present invention concerns the use of equally yielding webs and the relative positions of the same one to another.

In one aspect of the present invention, there is provided a sleeve for use in the treatment of textile threads and yarns including dying having a shell wherein the shell comprises peripherally extending spaced-apart rings which are elastically yielding in the axial direction of the shell and spaced-apart webs which are elastically yielding in the axial direction of the shell, connecting the rings, the axially consecutive webs being laterally off set relative to each other whereby when said rings and webs are yielding, said rings become serpentine and webs become bowed at least selected ones of said webs being adapted to bow in a selected common direction generally circumferential with respect to said sleeve to ensure substantially uniform displacement of the sleeve members, thus to provide a sleeve having minimum restriction for passage of dye and which sleeve is substantially rigid in yielded or non-yielded state.

In a further aspect of the present invention, there is provided a sleeve for use in the treatment of textile threads and yarns including dying having a shell wherein the shell comprises peripherally extending spaced-apart rings which are elastically yielding in the axial direction of the shell and spaced-apart webs which are elastically yielding in the axial direction of the shell, connecting the rings, said webs being grouped in pairs to provide axially consecutive pairs of webs laterally off set relative to each other whereby when said rings and said webs are yielding, in response to axial compression of the sleeve said rings become serpentine and webs become bowed, thus to provide a sleeve having minimum restriction for passage of dye and which is substantially rigid in yielding or nonyielded state.

In a further aspect of the present invention, there is provided a sleeve for use in the treatment of textile threads and yarns including dying having a shell wherein the shell comprises peripherally extending spaced-apart rings which are elastically yielding in the axial direction of the shell and spaced-apart webs which are elastically yielding in the axial direction of the shell, connecting the rings, the axially consecutive webs being laterally off set relative to each other and all being adapted to yield uniformly during compression of the sleeve, as for example during a dying operation.

BRIEF DESCRIPTION OF DRAWINGS

The invention is illustrated by way of example in the accompanying drawings wherein:

FIGS. 2*a* to 4*a* inclusive are fragmentary views of the respective sleeve constructions shown in FIGS. 2 to 4 inclusive following compression of the respective tubes, the compression being carried out to a selected degree.

FIGS. 2*a* to 4*a* inclusive and 2*b* also serve to illustrate, in some instances at least, pre-compressed shell or sleeve construction, which maybe further compressed to provide a "closer knit" of sleeve construction, yet still providing minimum restriction for dye flow.

DESCRIPTION OF PREFERRED EMBODIMENTS

As will be realized from the description hereinafter, the amount of compression of a tube can be selected. The present invention readily permits a reduction in a given tube length by as much as 50% of its original non-compressed length.

Figure 1:
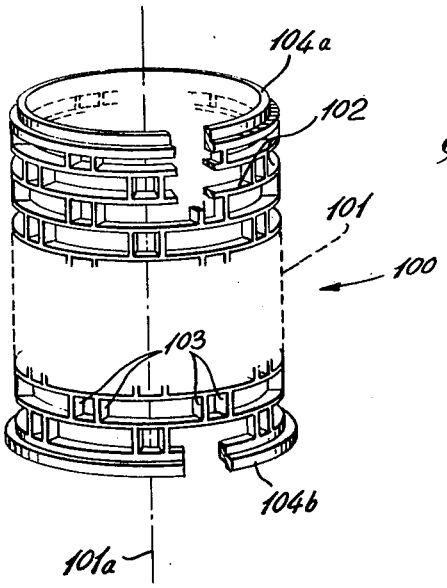
FIG. 1 is an oblique view of a tube in accordance with the present invention.

Turning now to the detailed description. FIG. 1 illustrates a tube 100 comprising a sleeve of thermoplastic material for treatment of threads or yarn having a shell 101 wherein the shell comprises peripherally extending spaced-apart rings 102 which are elastically and plastically yieldable in the axial direction of the shell and spaced-apart webs 103 which are also elastically and plastically yieldable in the axial direction of the shell, interconnecting rings 102, tube 100 also including spaced-apart end rings 104*a* and 104*b*, the axially consecutive webs 103 being laterally off set relative to each other. The yielding of rings 102 and webs 103 occurs during compression of tube 100 during use, the compression forcing the end rings 104*a* and 104*b* toward one another and thus reducing the length of tube 100.

As further seen in FIG. 1, webs 103 are elongated longitudinal members, substantially rectangular in cross-section and shape, rings 102 are equidistantly spaced apart along the longitudinal axis 101*a* of shell 101. Also, in the case of the embodiment shown in FIG. 1 and others, rings 102 and webs 103 are integral. This need not be of course and depends upon the nature of the construction of the tube employed.

Figure 2A:
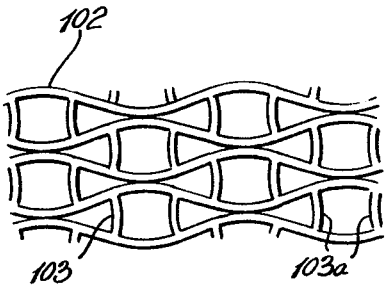

Tube 100 is further constructed in such a manner that during compression of the same rings 102 become serpentine and webs 103 become arcuate and bowed as shown in FIG. 2*a*. With webs 103 being bowable thus becoming bowed and not collapsed, as in the case of one of the aforementioned Burchette tubes, they maintain a degree of spring and resilience and ensure maximum aperture and accordingly minimum restriction for passage of dye during a dying operation.

Referring again to FIG. 1, end rings 104*a* and 104*b* may be of any suitable design including that shown, being of conventional design, which are adapted to receive and register concentrically therewith further tubes 100, thus to provide selectively an assembly of tubes 100 in end-to-end arrangement, per conventional arrangement.

Attention is again directed to FIGS. 2, 2*a* and 2*b* concerning the aforementioned preferred embodiment wherein it is seen shell 101, webs 103 connecting rings 102 are grouped in pairs 103*a* to provide axially consecutive pairs of webs laterally off set to each other. As seen in FIG. 2*a* for example rings 102 become arcuate and serpentine and webs 103 become arcuate and bowed due to the forces exerted by webs 103 on rings 102 during compression of the tube. It will be appreciated webs 103 always bend in the manner shown in FIG. 2*a* and 2*b* to provide the uniform knit comprising the shell 101.

Figure 4:
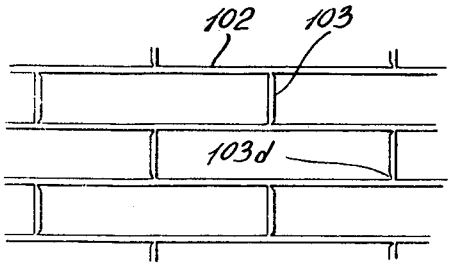
Figure 4A:
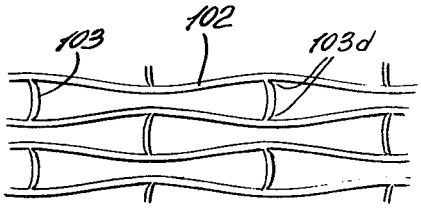

This is in contrast to some extent to that shown in FIG. 4*a* wherein the webs 103 bend into an arcuate and bowed shape, some bending in one direction and others in another in alternate rows. The shown direction of bending results from the weakened portions 103*d*, seen in FIGS. 4 and 4*a*, comprising the interconnection of webs 103 to rings 102. Without such controlled direction of bending, shell 101 would not compress uniformly. If desired, the weakened portions 103*d* maybe positioned in a common side of webs 103 so that all bow in a common direction generally circumferential with respect to the shell or sleeve 101. As may be realized, weakened portion 103*d* is not utilized or required in the sleeve construction according to FIG. 1 embodiment.

Figure 2:
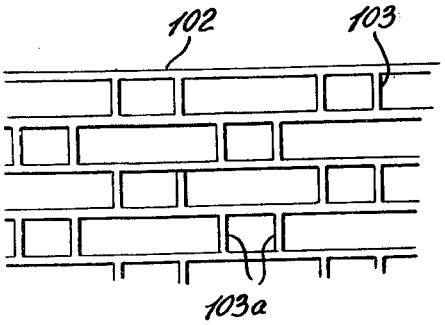
FIGS. 2 to 4 inclusive are fragmentary views of portions of tubes in accordance with the present invention, being alternative sleeve constructions to that shown in FIG. 1, except FIG. 2, which is the construction shown in FIG. 1, and shows such construction prior to compression of the respective tubes.
Figure 2B:
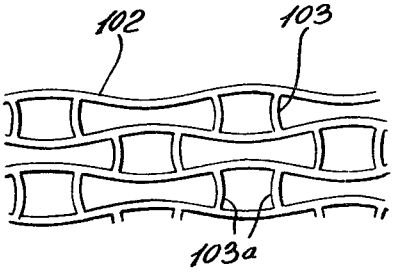
FIG. 2*b* for example, is similar to FIG. 2*a* showing less compression of the tube of FIG. 1.

As further seen in FIGS. 2 and 2*a*, rings 102 are equidistantly spaced apart along axis 101*a* and the pairs of webs 103*a* are equidistantly spaced apart transversely around shell 101 and the axially consecutive pairs of webs 103*a* are off set relative to each other by one half of the transverse spacing.

As again seen in FIG. 2*a*, rings 102 and webs 103 are adapted to yield such that rings 102 contact ones located on respectively opposite sides thereof. Such permits in some instances a reduction of as much as 50% of the original length of the tube 100 prior to compression.

Tube 100 may be constructed from any suitable material including thermoplastics which are desirable, since apart from the elastic and yielding properties of the material, lend themselves to use in molding.

Rings 102 and webs 103 maybe of any suitable shape in cross-section including being substantially rectangular, as shown in FIG. 1. In the preferred embodiment shown in FIG. 1, rings 102 and webs 103 are of similar dimension cross-sectionwise. End rings 104*a* and 104*b* as seen in FIG. 1, are of conventional design, as indicated above, one having an annular recess and the other a mating registrable annular projection.

Figure 3:
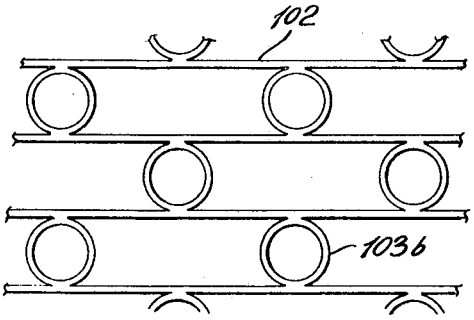
Figure 3A:
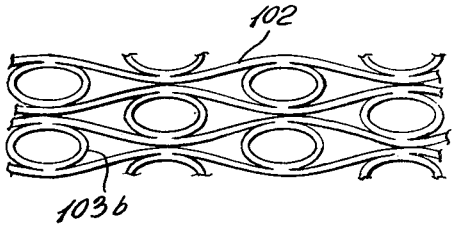

Attention is now directed to FIGS. 3 and 4 showing alternative sleeve constructions. FIGS. 3 and 4 merely show some of the alternative constructions, it being understood others can be readily provided and which are generic to the present invention. Such others could include for example irregular spaced webs 103 rather than equidistantly spaced webs 103 also, rings 102 could be irregularly spaced along the axis 101*a*.

FIG. 3 discloses webs 103*b* being of circular configuration, or the like being a pair of webs prebowed, joining and facing one another.

FIG. 4 is yet a further alternative construction as referred to previously, wherein webs 103 are equidistantly spaced apart transversely around shell 101 also, the axially consecutive longitudinal webs 103 are off set relative to each other by one half of the transverse spacing. Like the other alternative sleeve constructions disclosed, the webs and rings are of similar cross-section shapewise and dimensionwise.

Tubes according to the present invention may be made in a variety of sizes both in terms of length and diameter including basic sizes commonly used at present in the textile industry.

From the foregoing, it will be readily realized there is provided by the present invention a substantially improved dye tube or the like to that available in the prior art.

We claim:

1. A sleeve for use in the treatment of textile threads and yarns including dyeing having a shell wherein the shell comprises peripherally extending axially spaced-apart rings which are elastically yielding in the axial direction of the shell and peripherally spaced-apart webs which are elastically yielding in the axial direction of the shell, said webs extending axially between and connecting together axially adjacent ones of said rings, the axially consecutive webs being laterally off set relative to each other whereby when said rings and webs are yielding, said rings become serpentine and webs become bowed, at least selected ones of said webs being adapted to bow in a selected common direction generally circumferential with respect to said sleeve to ensure substantially uniform displacement of the sleeve members, thus to provide a sleeve having minimum restriction for passage of dye and which sleeve is substantially rigid in yielded or non-yielded state.

2. A sleeve as defined in claim 1 wherein said webs comprise elongated longitudinal members.

3. A sleeve as defined in claims 1 or 2 wherein said webs comprise arcuate members prior to yielding.

4. A sleeve as defined in claims 1, 2 or 3 wherein said rings are serpentine prior to yielding.

5. A sleeve as defined in claim 1 wherein the rings are equidistantly spaced apart along the longitudinal axis of the shell and the webs are equidistantly spaced apart transversely around the shell and the axially consecutive webs are off set relative to each other by one half of the transverse spacing.

6. A sleeve as defined in claim 1 wherein the rings and webs are integral.

7. A sleeve for use in the treatment of textile threads and yarns including dyeing having a shell wherein the shell comprises peripherally extending axially spaced apart rings which are elastically yielding in the axial direction of the shell and peripherally spaced apart webs which are elastically yielding in the axial direction of the shell, said webs extending axially between and connecting together axially adjacent ones of said rings, said webs being grouped in pairs to provide axially consecutive pairs of webs laterally off set relative to each other whereby when said rings and said webs are yielding, in response to axial compression of the sleeve, said rings become serpentine and said webs become bowed, thus to provide a sleeve having minimum restriction for passage of dye and which is substantially rigid in yielded or non-yielded state.

8. A sleeve as defined in claim 7 wherein said rings are equidistantly spaced-apart along the axis of the shell and the pairs of webs are equidistantly spaced-apart transversely around the shell and the axially consecutive pairs of webs are off set relative to each other by one half of the transverse spacing and wherein said pairs of webs when yielding bow in a direction toward one another.

9. A sleeve as defined in claim 8 wherein said rings and webs are adapted to yield such that at least some of said rings contact adjacent ones located on respectively opposite sides thereof.

10. A sleeve as defined in claim 7 wherein said rings and webs are adapted to yield such that said sleeve is reduced in length by at least 50% of its original uncompressed length.

11. A sleeve as defined in claim 7 wherein said webs comprise elongated longitudinal members.

12. A sleeve as defined in claim 7 wherein said webs comprise arcuate members prior to yielding.

13. A sleeve as defined in claim 7 wherein said rings are serpentine prior to yielding.

14. A sleeve as defined in claim 7 wherein the rings and webs are integral.

15. A sleeve for use in the treatment of textile threads and yarns including dyeing having a shell wherein the shell comprises peripherally extending axially spaced-apart rings which are elastically yielding in the axial direction of the shell and peripherally spaced-apart webs which are elastically yielding in the axial direction of the shell, said webs extending axially between and connecting together axially adjacent ones of said rings, the axially consecutive webs being laterally off set relative to each other and all webs being adapted to yield uniformly during compression of the sleeve, as for example during a dyeing operation.

* * * * *